US005586422A

United States Patent [19]

Hoffner

[11] Patent Number: 5,586,422

[45] Date of Patent: Dec. 24, 1996

[54] LOG ILLUSION VINYL LOG SIDING

[76] Inventor: Terrell W. Hoffner, 3128 Indian Rd., Davenport, Iowa 52802

[21] Appl. No.: 491,391

[22] Filed: Jun. 16, 1995

[51] Int. Cl.[6] ..... E04B 1/10

[52] U.S. Cl. ..... 52/529; 52/233; 52/519; 52/546

[58] Field of Search ..... 52/233, 519, 529, 52/536, 539, 546

[56] References Cited

U.S. PATENT DOCUMENTS

| | | | |
|---|---|---|---|
| 1,953,460 | 4/1934 | Bernhard | 52/233 |
| 2,829,404 | 4/1958 | Wilson | 52/233 |
| 3,969,859 | 7/1976 | Hisey | 52/233 X |
| 4,126,977 | 11/1978 | Chisum | 52/233 |
| 4,288,954 | 9/1981 | O'Donnell | 52/233 |
| 4,305,238 | 12/1981 | Harward et al. | 52/233 |
| 4,649,683 | 3/1987 | Dolata | 52/233 |
| 4,712,351 | 12/1987 | Kasprzak . | |
| 5,181,358 | 1/1993 | Mead | 52/233 |
| 5,198,242 | 3/1993 | Groeblacher et al. . | |
| 5,203,941 | 4/1993 | Spain et al. . | |
| 5,232,751 | 8/1993 | Cameron et al. . | |
| 5,253,458 | 10/1993 | Christian | 52/233 |
| 5,271,878 | 12/1993 | Mizia et al. | 52/233 X |
| 5,284,693 | 2/1994 | Spain et al. . | |
| 5,306,548 | 4/1994 | Zabrocki et al. . | |

*Primary Examiner*—Wynn E. Wood
*Attorney, Agent, or Firm*—Henderson & Sturm

[57] ABSTRACT

Siding having members which give the structure to which they are attached the illusion of construction from wooden logs. Other accommodating features, such as half and quarter panels, allow attachment to a building having commonplace irregularities, for example, doors and windows. The structures disclosed herein also provide for the inclusion of additional insulation, for attachment of the siding members to each other, and for attaching the siding to a building.

6 Claims, 3 Drawing Sheets

LOG ILLUSION VINYL LOG SIDING

TECHNICAL FIELD

This invention relates generally to siding systems for buildings and, more specifically, to siding systems for buildings which provide the illusion of construction from logs.

BACKGROUND ART

In the field of siding, especially with respect to vinyl siding, there exist myriad and diverse methods for producing siding which has a wood-like appearance as well as methods for attachment of such siding to permanent structures. For Example, U.S. Pat. No. 5,203,941 to Spain et al., teaches a method for producing vinyl panels embossed wood grain pattern. Another example is provided by U.S. Pat. No. 5,232,751 to Cameron et al., wherein similar siding is manufactured having wood-like striations. These and other examples in the art are all sufficient for their intended function; however, they are geared toward the production of siding which gives the illusion of split wood planks and are, therefore, implicitly flat. Also, the use of insulation with such siding is often overlooked.

Those desiring siding giving the illusion of construction from logs have heretofore been limited in their choices or without option entirely. A need for a siding system which would provide such an illusion while being easily installed and maintained clearly exists. A further need for the use of insulation in an easy and effective manner is also clear.

SUMMARY OF THE INVENTION

The present invention relates to a siding system having members which give the structure to which they are attached the illusion of construction from wooden logs. Further, outside corner members having the appearance of stacked logs meeting at right-angles are provided. Other accommodating features (such as half and quarter panels) which allow attachment of the siding to a building having commonplace irregularities (e.g., windows, doors, inside corners), are also provided. Attachment structures and connection of the various members to each other are also disclosed.

Therefore, it is an object of this invention to provide improved siding having the outward appearance of wooden logs.

A further object is to provide a method for the connection of various members of the siding not only to each other but also to any building having conventional irregularities such as windows.

Another object of the invention is to provide for the containment of additional insulation for the structure to which the siding is attached.

Other objects, advantages, and novel features of the present invention will become apparent from the following detailed description of the invention when considered with the accompanying drawings.

BEST MODE FOR CARRYING OUT THE INVENTION

Figure 1:
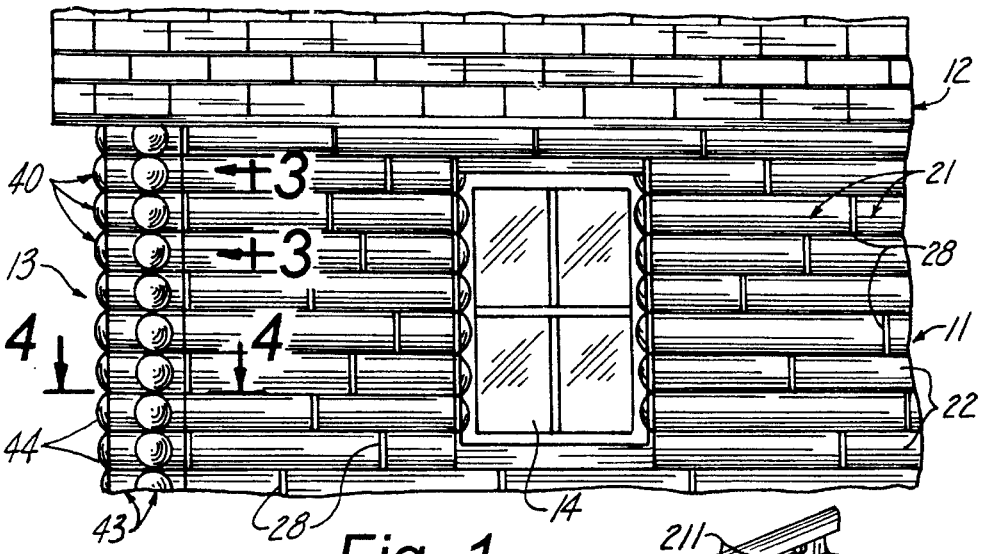
FIG. 1 is a side perspective view of the side of a building to which the invention is attached.

Referring now to the drawings, wherein like numerals represent the same or similar structures throughout the several views, FIG. 1 provides a perspective side view of a building (12) to which the siding (11) of the present invention has been installed in the preferred way. Representations of an outside corner (13) and a window (14) have been shown in order to provide illustration for certain accommodating aspects of the present invention which will be made clear below.

Figure 2:
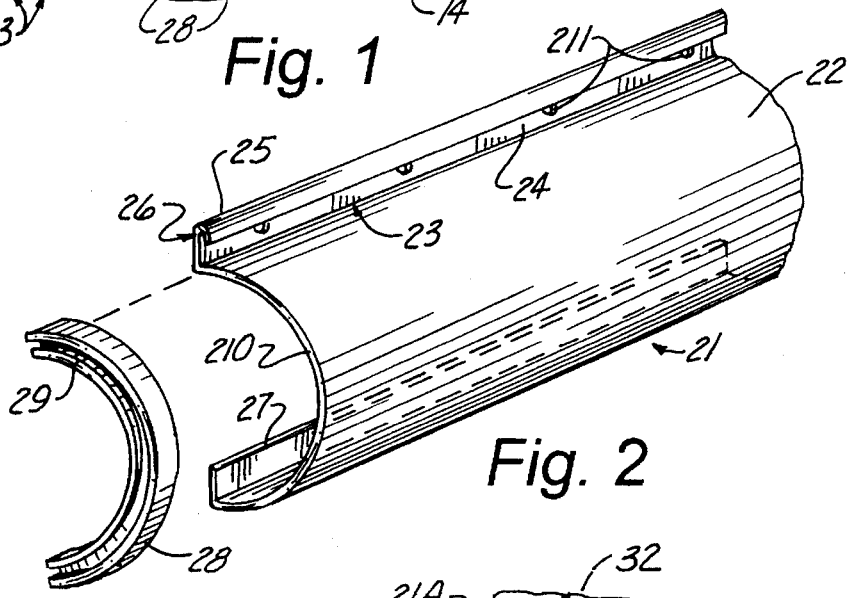
FIG. 2 is a perspective view of a siding member and connector.

FIG. 2 illustrates, in perspective view, a siding member (21) which is the primary functional unit of the invention at hand. The siding member (21) is generally in the shape of a semi-cylindrical shell and has a longitudinal dimension substantially greater than it transverse dimension. Further, this and other siding pieces which will described below are preferably constructed from a substance such as vinyl, aluminum, or steel which has the desirable characteristics of conventional siding (e.g., pliability, strength, lightness) as well as impressionability. The curved outer surface (22) of the siding member (21) can be provided with any of a multitude of patterns and colors but is particularly suited, due to its general shape, to simulate the color and texture of a log.

Extending outwardly relative to the semi-cylinder formed by the curved outer surface (22) and along the upper longitudinal edge of the siding piece (21), a formed receiving portion (23) having a generally flat attachment section (24) and a sharply curved capture section (25) is provided. Considering the sharply curved capture section (25) of the receiving portion (23), it becomes apparent that a groove (26) is formed. The attachment section (24) of the siding piece (21) further provides a plurality of apertures (211) spaced at intervals along its length whose function will be made clear later in this description.

Along the lower longitudinal edge of the siding member (21) and directed inwardly relative to the curved outer surface (22), an elongated tongue (27) is provided having a shape which is mated to that of the receiving portion (23) of another functionally identical siding member (21). The details of this connection process will be made clear below.

Figure 3:
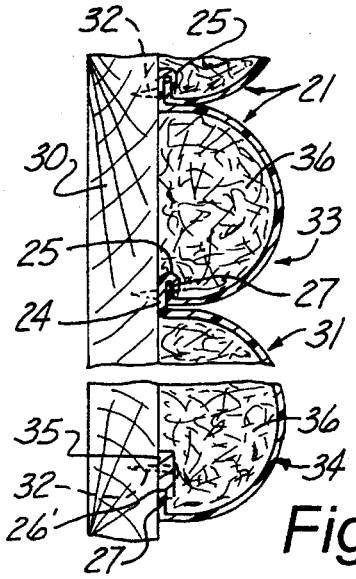
FIG. 3 is a side cutaway view of the attached siding.

With reference to FIG. 3, which is related to FIG. 1 by line 3—3, a cross sectional view of the present invention in its connected and finished form is illustrated. A generalized wall (30) is shown which serves as the base to which a series of siding members (21) are attached. Considering their shape, color and texture, these siding members (21) provide the illusion of a wall constructed from wooden logs. As can be seen in FIG. 3, the siding members (21) are connected to each other and attached to the wall (30) in a particular way. A lower siding member (31) is secured to the wall (30) by way of a nail (32) being driven into the wall (30) through each aperture (21) of its attachment section (24). An upper siding member (33) is connected to the lower siding member (31) by way of having its tongue (27) fitted into the groove (26) formed by the curved capture section (25) of the lower siding piece (31) such that matched, captured securement is accomplished. Thus the upper (33) and lower (31) siding members form a connection which is impervious to the elements.

Of course the lowest siding member (34) must have a groove (26) in which to have its tongue (27) received and which, of necessity, cannot be provided by another siding member (21). Therefore, a securing strip (35), having on its lower longitudinal edge an equivalent groove (26'), is provided. The securing strip (35) is also attached to the wall in a permanent way such as that provided by a series of nails (32).

FIG. 2 further illustrates a connector (28) having a shape that, when viewed along the major axis of the drawing, generally matches that of the siding member (21). Along the circumference of the connector (28) and on both sides, a connector groove (29) is provided for purposes of receiving the end portion (210) of a siding member (21). Thus, once engaged in the intended way, the connector (28) joins the end portions (210) of two siding members (21) as can be seen repeatedly in FIG. 1.

Further reference to FIG. 3 shows that each siding member (21), once secured and by virtue of its shape, provides a hollow volume suitable for holding insulation 36). The insulation (36) may be any of a variety of conformable types, such as foam, or blown fiberglass. With insulation (36) within the siding members (21), the effective thermal conductivity of the wall (30) is significantly reduced. Thus a building (2) covered with the siding (11) of the present invention is more resistant to undesirable loss or gain of thermal energy.

Obviously the individual structural features of any building (12) cannot be completely accommodated by repeated attachment of siding members (21) alone. Therefore the invention at hand provides certain features which allow practically any building to be covered with siding of a log-like appearance (11) provided that the building (12) has substantially flat walls (30) and corners (either inside or outside) which are at right angles.

Figure 4:
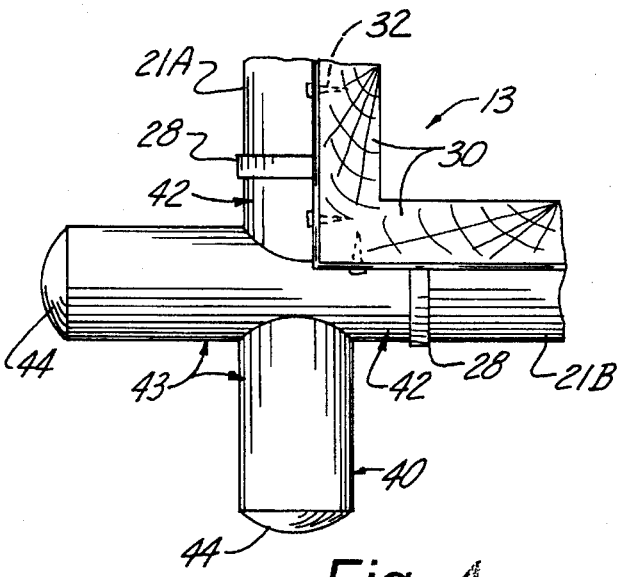
FIG. 4 is an overhead view of an outside corner member in its connected position.
Figure 5:
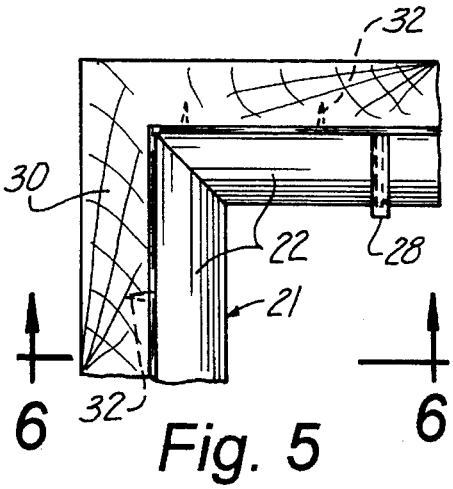
FIG. 5 is an overhead view of an inside corner member in its connected position.
Figure 6:
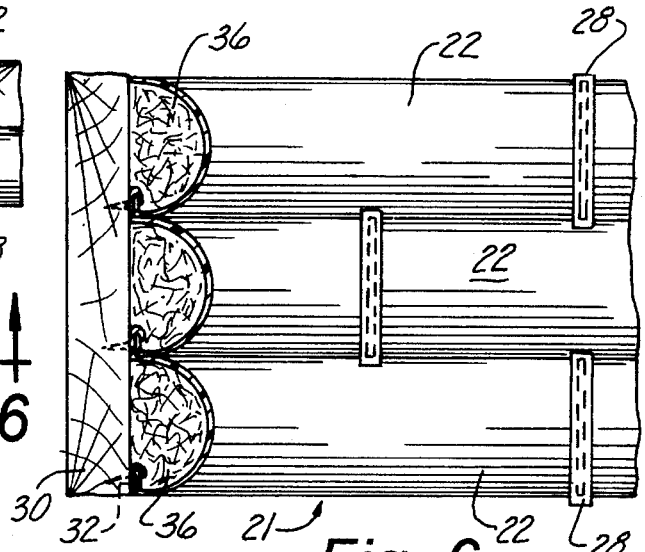
FIG. 6 is a perspective and cutaway view of an inside corner to which the siding is attached.
Figure 7:
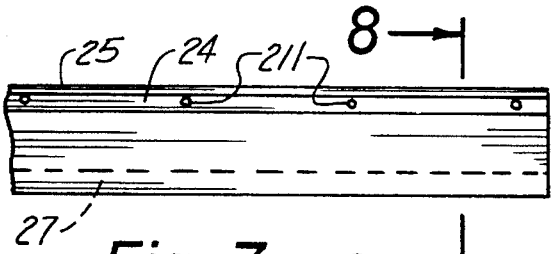
FIG. 7 is a front breakaway view of a half siding member.
Figure 8:
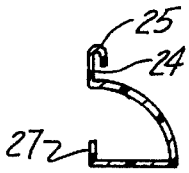
FIG. 8 is a front breakaway view of a side plane view of a half siding member.
Figure 9:
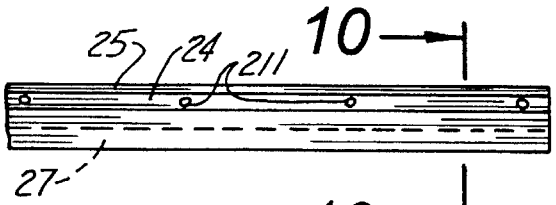
FIG. 9 is a front breakaway view of a quarter siding member.
Figure 10:
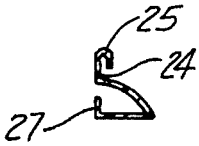
FIG. 10 is a side plan view of a quarter siding member.
Figure 11:
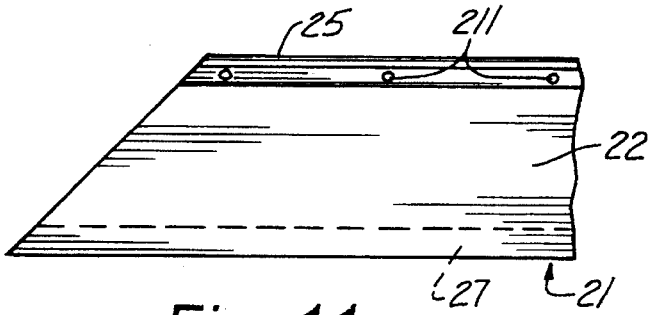
FIG. 11 is a from breakaway view of a siding member having a mitered end.

FIG. 4 is an overhead view of the first of these accommodating features and may be related to FIG. 1 by line 4—4. Where two walls (30) meet at a right angle, thereby forming an outside corner (13), an outside corner member (40) is provided. The outside corner member (40) is of such size and shape at its connection ends (42) that it may be joined to two terminal and normally disposed siding members (21A, 21B) by way of connectors (28). The manner in which the connectors (28) join the siding members (21A, 21B) to the outside corner member (40) is identical to the way in which two siding members (21) are connected horizontally to each other as described above. Another feature of the outside corner member (40) that further contributes to the illusion of a building constructed from wooden logs is provided by two perpendicular end projections (43). The end projections (43) are formed in such a way that they appear to pass through one another as extensions of the "logs" provided by the terminal siding members (21A, 21B). Thus the end projections (43) of the outside corner member (40) are at the same vertical level once installed. This of course simulates the outside corner configuration of actual wooden log walls which would normally have notches near, but not at, the ends of their perpendicular logs that would meet in matching connection. Rounded end caps (44), which are preferably of a color similar to that of the interior of a log, are also provided. Functionally, the end caps (44) seal the ends of the end projections (43) while aesthetically they further the appearance of a cut wooden log.

Figure 12:
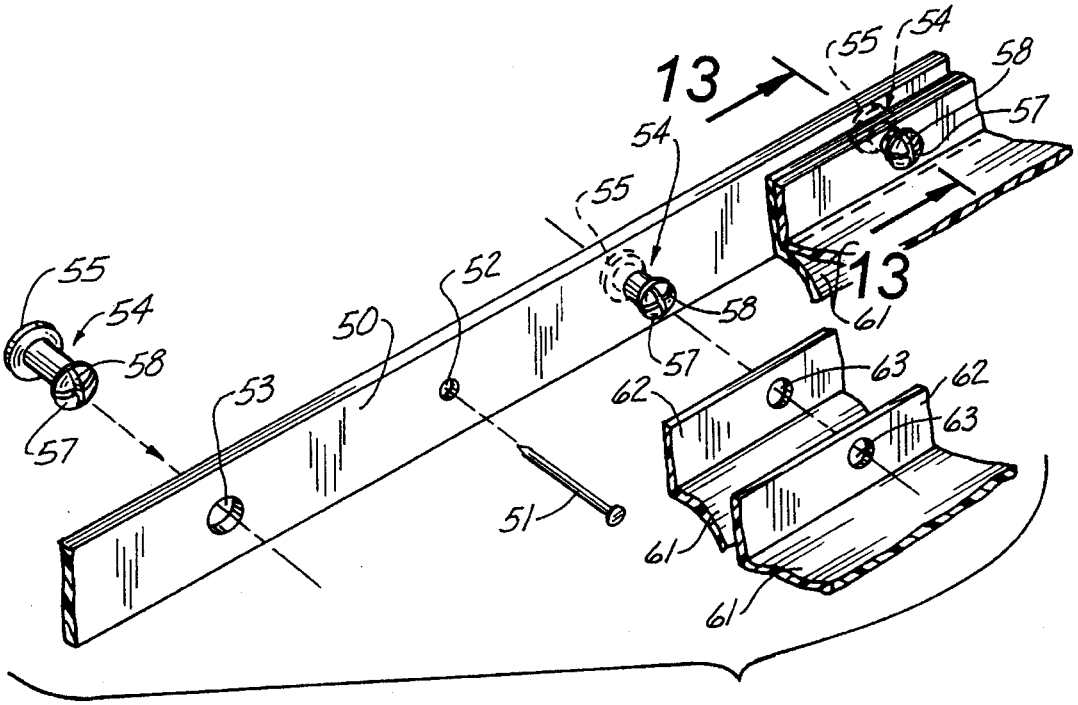
FIG. 12 is perspective view of an alternate means for attachment of the siding to a structure.
Figure 13:
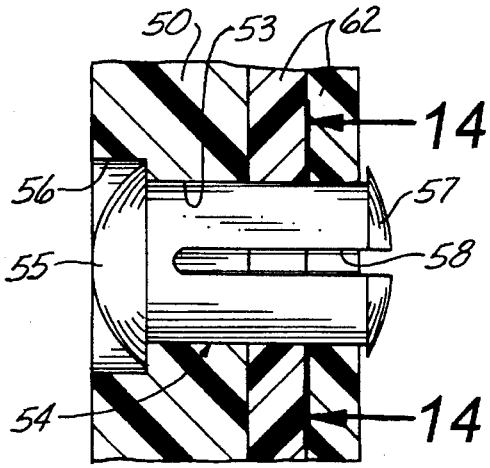
FIG. 13 is a side plan view of the operative attachment component of the embodiment shown in FIG. 12.
Figure 14:
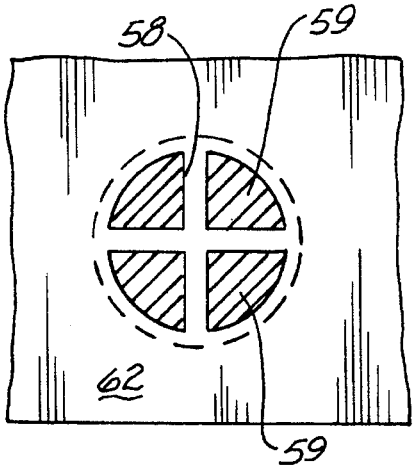
FIG. 14 is a front plan view of the operative attachment component of the embodiment shown in FIG. 12.

Referring now to FIGS. 12–14, an alternate way to connect the siding to a building is shown wherein a strap (50) can be nailed to the side of the building by guiding nails (51) through openings (52) which are spaced along the strap (50). Openings (53) are also provided at evenly spaced intervals along the strap (50) for permitting a fastener (54) to be placed therethrough from the inside adjacent the wall to the outside as shown on the two fasteners (54) on the right side of FIG. 12. The fasteners (54) would need to be extended through the openings (53) before the strap (50) is nailed to the building wall.

Once all of the fasteners (54) are in place, then the siding members (61) can be held in place by merely moving the flanges (60) to having opening (63) therein until they are in position shown in FIG. 13. The enlarged head (55) on fastener (54) is in a counter-sunk hole (56) in strap (50) and is prevented from passing to the right as viewed in FIG. 13 beyond the position shown. The other end (57) of the fastener (54) is enlarged so that once the flanges (62) are held in place as shown in FIG. 13 they will not fall off because of the enlarged head (57).

The fastener (54) is preferably formed of an elastomeric, resilient material which will hold its shape but yet will bend to some extent. For example, it will bend inwardly to go through the hole (53) by having the enlarged head (57) move inwardly as it passes through the openings (53) and (63). This is permitted because of the X-shaped slot (58) formed through most of the length of the fastener (54). This allows segments (59) to flex inwardly when going through the openings (53) and (63) and then permits them to flex back to their original shape as shown in FIGS. 12–14 once the fastener (54) has passed through such openings.

If desired, a shorter version of the fastener (54) could be utilized for the lowest section of siding (61) on each job because it would only fasten the bottom of one flange to the wall of the building instead of two so the fastener (54) would be shortened by one thickness of wall (62).

Obviously, many modifications and variations of the present invention are possible in light of the above teachings. It is, therefore, to be understood that, within the scope of the appended claims, the invention may be practiced otherwise than as specifically described.

I claim:

1. Siding apparatus in combination with a building having a planer outer surface thereon, said siding comprising:

a first elongated siding member having an upper edge and a lower edge, first end and a second end;

means for attaching said first siding member to said surface;

a second elongated siding member having an upper edge, a lower edge, a first end and a second end;

means for attaching the upper edge of the first elongated siding member to the lower edge of the second siding member and to said building surface whereby said first and second elongated siding members will cover a portion of said surface;

wherein said first and second siding member are C-shaped in cross-section to resemble logs; and wherein said means for attaching the upper edge of said first elongated siding member to the lower edge of said second siding member included a strap attached to said surface, said strap having an opening therein through which extends a fastener, said fastener having a first end adjacent to the surface, said first end being larger than the opening; a second end of said fastener being larger than holes in said siding members, said second fastener end being deformable to extend through said holes in the siding and resilient enough to spring back to its original larger shape once through the holes in said siding to thereby hold the siding to said surface.

2. The apparatus of claim 1 including insulation disposed between said siding members and said surface.

3. The apparatus of claim 1 wherein substantially the entire outer surface of said building is covered with abutting elongated siding members having a structure substantially similar to said first and second elongated siding members.

4. The apparatus of claim 3 including corner trim members for connecting the elongated siding members on corners of said surface for simulating the look of the corners of a log building.

5. The apparatus of claim 1 wherein said surface has a window therein; and trim members attached around said window and to said elongated siding members for simulating the look of a log building, portions of said trim member being arcuate in cross section.

6. The apparatus of claim 1 wherein said C-shaped members are substantially semi-circular in cross-section and substantially semi-cylindrical along their entire length.

* * * * *